United States Patent [19]

Murphy

[11] Patent Number: 4,785,599

[45] Date of Patent: Nov. 22, 1988

[54] FASCIA END PLATE FOR ROOF SYSTEM

[76] Inventor: Wesley T. Murphy, 94 Prospect St., Auburn, N.Y. 13021

[21] Appl. No.: 131,131

[22] Filed: Dec. 10, 1987

[51] Int. Cl.[4] ..... E04C 2/34; E04F 11/18

[52] U.S. Cl. ..... 52/302; 52/244; 52/301

[58] Field of Search ..... 52/302, 301, 244; 138/89; 248/901

[56] References Cited

U.S. PATENT DOCUMENTS

| | | | |
|---|---|---|---|
| 1,973,861 | 9/1934 | Walsh | 52/301 |
| 3,256,659 | 6/1966 | Dudoff | 52/301 |
| 3,282,006 | 11/1966 | Halsey | 52/301 |
| 4,509,306 | 4/1985 | Sokoler | 52/302 |

FOREIGN PATENT DOCUMENTS

| | | | |
|---|---|---|---|
| 2730087 | 1/1979 | Fed. Rep. of Germany | 52/244 |

*Primary Examiner*—Henry E. Raduazo
*Attorney, Agent, or Firm*—Wall and Roehrig

[57] ABSTRACT

A fascia end plate for sheet metal building construction has a face plate and a lower plate joined to a lower edge of the face plate at an angle of 75 degrees. A pair of legs extend horizontally from the top edge of the face plate and from the lower plate, each leg having a retaining tab at its end. The fascia end plate inserts into the box flanges of a sheet metal joist.

6 Claims, 1 Drawing Sheet

FASCIA END PLATE FOR ROOF SYSTEM

BACKGROUND OF THE INVENTION

This invention relates to sheet metal building construction and is more especially directed to a structural member that can be self-fastened to the end of a sheet-metal beam member. The invention is specifically directed to a fascia plate which mounts to the end of a sheet metal beam of the type that comprises a pair of box flanges.

Currently, fabrication of sheet metal building structures requires specialized tools, and considerable skill in the building trades. Because of the world-wide need for inexpensive, yet simple to construct housing, which could be owner-built on a self-help basis, there has long been a need for simple and durable building construction systems that can be assembled without much prior skill and without requiring special tools.

In addition to metal beams and connectors, there is a need for members to attach the roof to the structure, and especially for cornice devices, namely fascia brackets or end plates.

The sheet metal construction beams with which such a fascia end plate might be employed are described in my earlier U.S. Pat. Nos. 4,188,147 granted Jan. 12, 1980; 4,192,119 granted Mar. 11, 1980; and 4,201,026 granted May 6, 1980 and also in my copending U.S. patent application Ser. No. 086,382 filed Aug. 14, 1987.

OBJECTS AND SUMMARY OF THE INVENTION

It is therefore an object of this invention to improve the system of structural members used in the constructions of buildings and the like.

Another object of this invention is to provide a fascia end member which is self-fastening to an end of a sheet metal joist.

A further object of the invention is to provide a fascia member that snaps into place without special tools and remains held securely in a sheet metal beam.

In accordance with an aspect of this invention, a fascia end plate is provided for use with a so-called double-dee type sheet metal structural beam of the type that has matching right and left halves that fit together to form a double-thickness web and a pair of box flanges disposed one above and one below the web. The box flanges each have a rectangular cross-section to define a rectangular internal channel. The fascia end plate or bracket is formed unitarily of a rigid sheet material, i.e. sheet steel, although molding or forming from a synthetic resin, e.g. HDPE, is also possible. A rectangular face plate is joined at its lower edge to a horizontal lower plate. The face plate and lower plate makes an acute angle such as 75 degrees. A pair of parallel upper legs, preferably disposed side-by-side in the same plane, extend horizontally from an upper edge of the face plate and are joined to it at an obtuse angle, such as 105 degrees that is, at an angle that is supplementary to the acute angle, (here 75 degrees),at the lower edge of the face plate. Another, lower pair of side-by-side parallel legs extend horizontally from the edge of the lower plate away from the face plate. Each of the legs has a tab at its free end, the tabs of the upper legs being bent down and those of the lower legs being bent upwards, at an acute angle, such as 60 degrees. The legs and tabs are suitably dimensioned to permit insertion of the fascia end plate legs into the upper and lower box flanges of the sheet metal beam, but to prevent their withdrawal once inserted. The face pate can serve to receive a nail, sheet metal screw or drywall screw so that a sheeting or roofing member can be attached.

The fascia end plate element should be suitably dimensioned to mate with the sheet metal beam used in the construction. In a preferred mode, the beam has an overall height of about 98 mm or $3\frac{7}{8}$ inches, with a web of about 60 mm or 2 5/16 inches. The box flanges have an internal dimension of about 20 mm by 38 mm in height and width, i.e., about 11/16 inches by $1\frac{1}{2}$ inches. For this environment, the fascia end plate embodiment has a face plate of about 100 mm by 40 mm, i.e., 4 inches by $1\frac{5}{8}$ inches, a lower plate of 40 mm by 37 mm or $1\frac{5}{8}$ inches by $1\frac{1}{2}$ inches, with both the upper and lower legs being 25 mm by 15 mm or 1 inch by $\frac{5}{8}$ inch with the tabs being about 22 mm by 16 mm or $\frac{7}{8}$ inch by $\frac{5}{8}$ inch. The legs of each pair are spaced by a gap of about 3 mm or $\frac{1}{8}$ inch.

The above and other objects, features, and advantages of this invention will be more fully understood from the ensuing description of a preferred embodiment when read in connection with the accompanying drawing.

DETAILED DESCRIPTION OF THE PREFERRED EMBODIMENT

Figure 1:
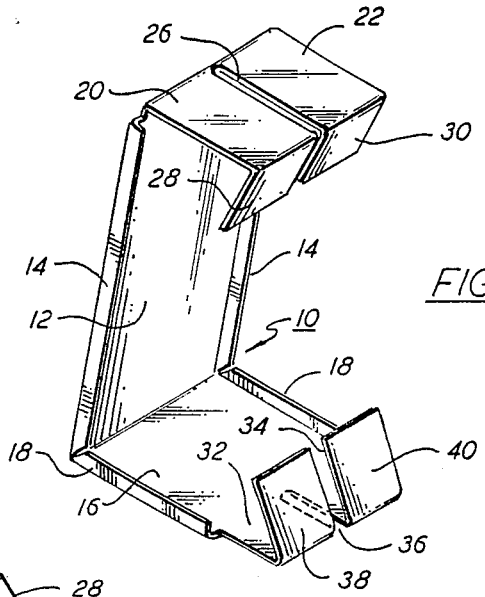
FIG. 1 is a perspective view illustrating a fascia end plate device according to one embodiment of this invention.

As illustrated in FIG. 1 a fascia bracket or end plate unit 10 which is unitarily formed of a single piece of steel sheet. A face plate 12 dimensioned four inches by one and five eighth inches has side flanges 14 of about one-eighth inch width. A lower plate 16 of the same width and about one and one half inches in length is joined to the lower edge of the face plate 12, making an acute angle with it, here about seventy five degrees. The lower plate has side flanges 18 of about one-eighth inch width.

At the upper edge of the face plate 12 there are two parallel legs 20 and 22, which extend parallel to the lower plate 16, and thus make an obtuse angle of about one hundred five degrees with the face plate 12. These legs 20,22 extend side-by-side in a common plane, with a small gap 26 between them. These legs are about one inch in length, and have down-turned retaining tabs 28,30 at their ends, with the tabs making an acute angle of about sixty degrees with the legs.

At the lower plate 16 at the edge remote from the face plate 12 there are another pair of parallel legs 32 and 34, which extend side-by-side with a narrow gap 36 therebetween. Each of these legs is about one inch long and has a bent-upwards retaining tab 38 and 40, respectively, making an acute angle of about sixty degrees. The tabs are generally about seven-eighth inch in length.

Figure 2:
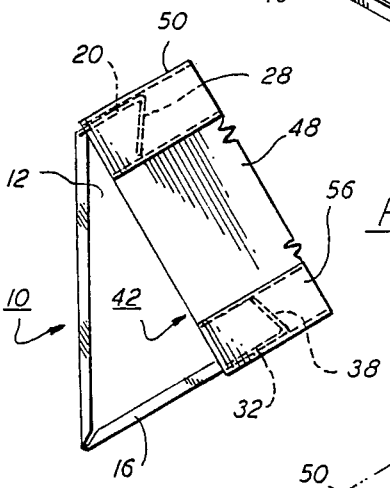
FIG. 2 is a partial elevational view showing the fascia end plate assembled into one end of a sheet metal beam.
Figure 3:
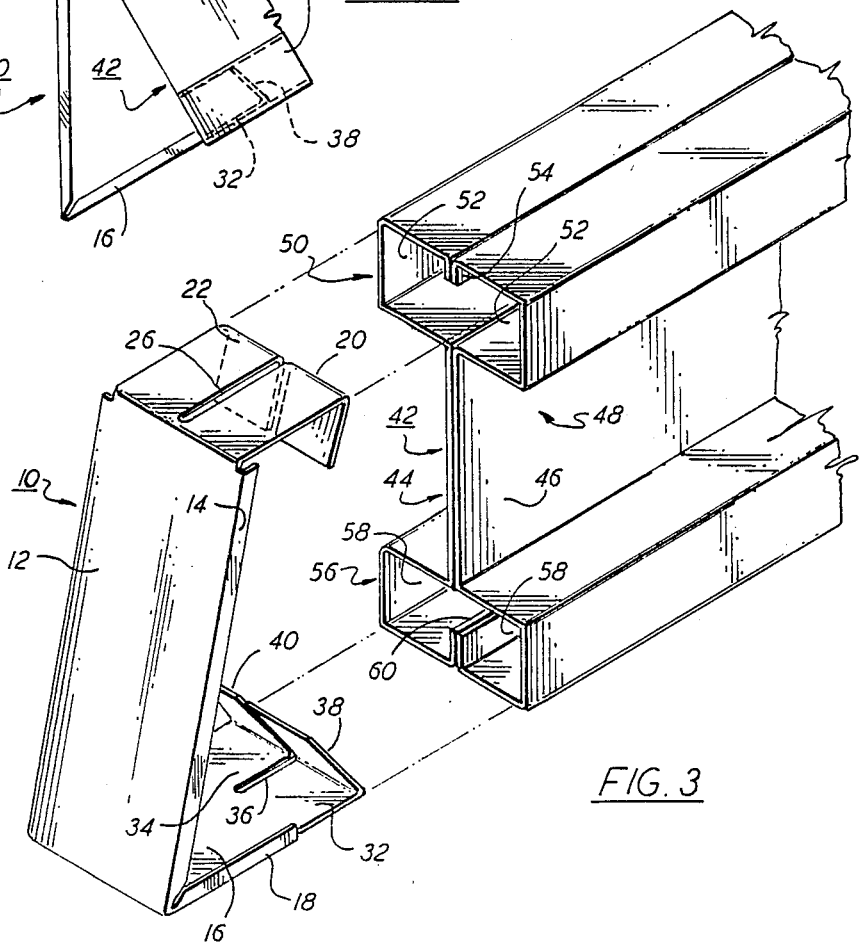
FIG. 3 is another perspective view showing the fascia end plate and associated sheet metal beam.

The legs 20,22, 32,34 and the lower plate 16 are generally disposed horizontally, and inserted into one end of a sheet metal joist or beam 42, as shown in FIGS. 2 and 3. The beam 42 is formed as a "double-dee" beam made of facing halves 44 and 46. The beam has a double thickness web 48 with a box flange 50 formed above it. The box flange is formed of a pair of facing channels 52 with a pair of abutting fins 54 which extend inward, i.e., towards the web 48.

Similarly, a lower box flange 56 is formed below the web 48 with facing channels 58 separated by upwardly extending bent-in fins 60. The interior space within the box flanges 50 and 56 is generally of a rectangular cross section one-and-one-half inches across by three-quarters inch high, with the fins 54 and 60 serving as medial septa dividing these spaces.

As shown in FIG. 3, the legs 20 and 22 of the fascia bracket or end plate unit 10 are inserted into the right and left halves of the upper box flange 50, and the lower legs 32 and 34 are inserted into the right and left halves of the lower box flange 56. The tabs 28, 30, 38, and 40 yield on insertion, but lock against the sides of the box flanges 50,56 as shown in FIG. 2, to prevent withdrawal. The gaps 26,36 fit over the fins 54 and 60, respectively.

The face plate 12 is oriented at an angle to the joist 42 with which the unit 10 is engaged. This follows the plane of the roof above the joist, and can align with a rafter (not shown). The sheet metal end plate 12 can be penetrated by a sheet metal screw or nail, to serve as a base onto which a panel can be attached by a suitable threaded fastener.

The terms of orientation as used herein, such as "horizontal", are used for convenience in explanation with reference to the drawing, but are not intended as terms of limitation, for it can be appreciated that the fascia end plate of this invention could be employed in any of a number of possible orientations.

Also, while the invention has been described with reference to a single preferred embodiment, it should be understood that the invention is not limited to that precise embodiment, and many modifications and variations would present themselves to those of skill in the art without departure from the scope and spirit of the present invention, as defined in the appended claims.

What is claimed is:

1. A fascia end plate for use with a double-dee type sheet metal beam of the type that has matching right and left halves that fit together to form a double-thickness web and box flange members above and below said web, each of which has an internal channel of substantially rectangular cross section; the fascia end plate being formed unitarily of a rigid sheet material and comprising a rectangular face plate; a lower horizontal plate having one end joined to a lower edge of the face plate at an acute angle; a pair of parallel upper legs extending horizontally from an upper edge of the face plate and joined thereto at an obtuse angle supplementary to said acute angle; and each of said legs having a respective bent down tab at its free end forming an acute angle with the associated leg; and a pair of parallel lower legs continuing substantially in the plane of said lower plate, each having a respective bent-up tab at its free end that forms an acute angle with the associated leg; with said legs and tabs being so dimensioned to permit insertion of the fascia end plate legs into the upper and lower box flanges of said sheet metal beam, but preventing their withdrawal once inserted therein.

2. The fascia end plate of claim 1 wherein the end plate is formed of a sheet steel.

3. The fascia end plate of claim 1 further comprising edge flanges at side edges of said face plate and of said lower plate.

4. The fascia end plate of claim 1 wherein said legs of each of the pair of upper and lower legs extend side-by-side in a common plane, with a narrow gap between them.

5. The fascia end plate of claim 1 wherein said legs are substantially one inch in length and five-eighth inch in width, and said tabs are seven-eighth inches in length and five-eighth inches in width, the acute angle between the leg and tab being substantially 60 degrees.

6. The fascia end plate of claim 1 wherein said sheet material is of a type suitable so that the face plate can receive and retain a threaded fastener.

* * * * *